United States Patent [19]

Heynisch

[11] Patent Number: 4,567,406

[45] Date of Patent: Jan. 28, 1986

[54] HIGH-GAIN KLYSTRON-TETRODE

[75] Inventor: Hinrich Heynisch, Gräfelfing, Fed. Rep. of Germany

[73] Assignee: Siemens Aktiengesellschaft, Berlin and Munich, Fed. Rep. of Germany

[21] Appl. No.: 609,788

[22] Filed: May 14, 1984

[30] Foreign Application Priority Data

May 16, 1983 [DE] Fed. Rep. of Germany ..... 3317788

[51] Int. Cl.[4] ..... H01J 23/08

[52] U.S. Cl. ..... 315/5.33; 315/5.34; 315/5.53

[58] Field of Search ..... 315/5.33, 5.53, 5.34

[56] References Cited

U.S. PATENT DOCUMENTS 2,840,753 6/1958 Dailey ..... 315/5.38

3,614,518 10/1971 Schmidt ..... 315/5.53

FOREIGN PATENT DOCUMENTS 1945826 11/1971 Fed. Rep. of Germany .

OTHER PUBLICATIONS

The Klystrode–An Unusual Transmitting Tube with Potential for UHF–TV, Proceedings of the IEEE, vol. 70, No. 11, Nov. 1982, pp. 1318–1325.

*Primary Examiner*—Harold Dixon

*Attorney, Agent, or Firm*—Laurence A. Greenberg; Herbert L. Lerner

[57] ABSTRACT

The disclosure related to an improved Klystron-tetrode which has some of the characteristics of a klystron and a tetrode having a hollow beam and tuned cavity resonators for optimizing the phase relation between resonator gaps.

2 Claims, 1 Drawing Figure

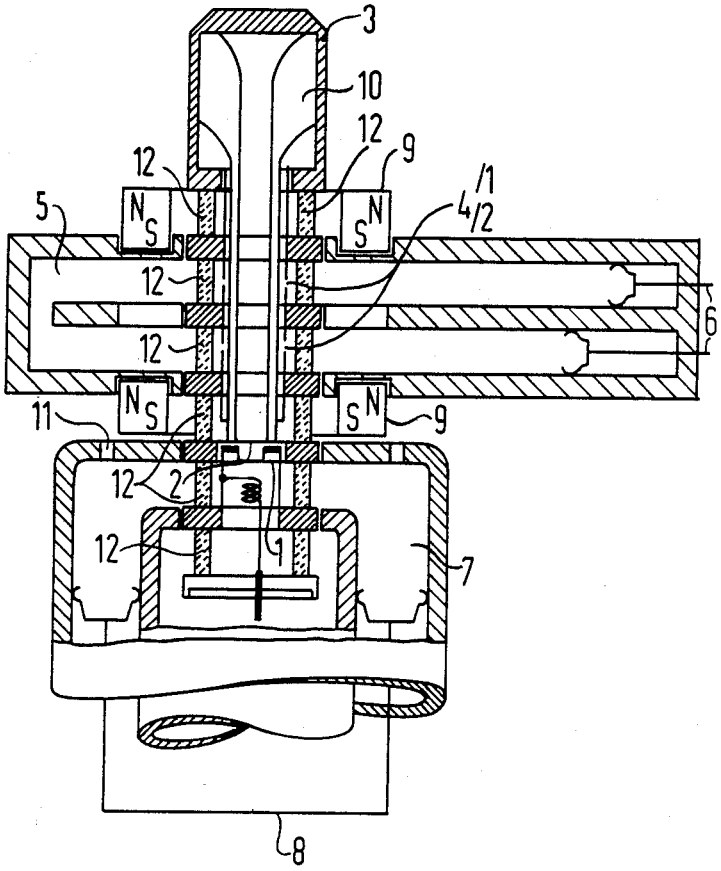
3
10
12
9
12
N
S
S
N
1
4
2
5
12
6
12
N
S
S
N
11
9
12
2
12
1
7
8

HIGH-GAIN KLYSTRON-TETRODE

The invention relates to a Klystron-Tetrode, which is also known by the Trademark "klystrode" owned by the firm Varian Associates, Inc., with a high gain, including a hollow-beam tube and an output resonator.

Such a klystron-tetrode is known from the publication by Preist and Shrader entitled: "The Klystrode - An Unusual Transmitting Tube with potential for UHF-TV", published in the journal: "Proceedings of the IEEE", Vol. 70, No 11, November 1982, pages 1318 to 1325. However, the gain of this klystrode is only about 20 dB.

German Patent No. 19 45 826 discloses another conventional concentrically constructed two-chamber klystron with a centrally disposed cathode, an input and output circuit, each concentrically surrounding the cathode and being perforated in vicinity of the electron stream in grid-fashion, as well as a collector. In vicinity of the electron stream, the output circuit is formed of a grid facing the cathode and the collector. The input circuit has a potential which is low as compared to the collector potential, and the grid of the output circuit has a potential which is depressed relative to the potential of the input circuit.

It is accordingly an object of the invention to provide a high-gain klystron-tetrode which overcomes the hereinafore-mentioned disadvantages of the heretofore-known devices of this general type, and to provide a power amplifier tube with small dimensions, low manufacturing costs, high gain and very high efficiency (about 60%), especially for the VHF/UHF frequency range.

SUMMARY OF THE INVENTION

With the foregoing and other objects in view there is provided, in accordance with the invention, a high-gain klystron-tetrode, comprising a tube for accomodating a hollow beam and an output resonator: including a ring cathode with a heater, two resonator gap apertures and a collector for generating the hollow beam; a ring grid for current-modulating the hollow beam; an external cavity resonator for current modulation, the external cavity resonator having a tuning slider of a grid-cathode circuit for operating the klystron-tetrode; and a re-entrant cavity resonator, the re-entrant cavity resonator having two independent tuning sliders for generating HF power by setting the resonator frequency and optimizing the phase between the resonator gap apertures for in-phase and substantially in-phase operation, and the re-entrant cavity resonator having magnets integrated therein for focusing the hollow beam.

In accordance with a concomitant feature of the invention, the beam perveance in vicinity of the re-entrant cavity resonator (output circuit) is greater than $2 \cdot 10^{-6} A/V^{3/2}$.

The higher gain values and a higher efficiency are achieved by the combination of a gain-controlled hollow-beam tube and a double-gap resonator.

The hollow beam permits a tube to be provided with a relatively high beam perveance ($P > 2 \cdot 10^{-6} A/V^{3/2}$). Firstly, this results in a relatively low supply voltage, and secondly, this results in a relatively steep characteristic for the grid modulation. These measures furthermore result in achieving high gain with a relatively coarse grid structure.

The cavity resonator for generating the HF power is constructed as a folded re-entrant cavity resonator (for in-phase or approximately in-phase operation). In this way, high efficiency ($\eta > 60\%$) with a high power gain is obtained. The gain is more than 30 dB.

Other features which are considered as characteristic for the invention are set forth in the appended claims.

Although the invention is illustrated and described herein as embodied in a high-gain klystron-tetrode, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single FIGURE.

DESCRIPTION OF THE DRAWING

The drawing is a diagrammatic, partly cross-sectional view of an embodiment of the invention.

DETAILED DESCRIPTION

Referring now to the figure of the drawing in detail, there is seen a klystron-tetrode which is formed substantially of a ring cathode 1 with a heater for generating a hollow beam or electron beam 10. A ring grid 2 is provided for current modulation of the hollow beam 10. Two resonator gap apertures 4 and a collector 3 are also provided. The klystron-tetrode is operated in external resonators with tuning sliders.

For this purpose, a cavity resonator 7 (grid-cathode circuit) is provided with a tuning slider 8. The device includes a re-entrant cavity resonator 5 which serves for generating the H-F power, that has two independent tuning sliders 6 for adjusting the resonance frequency and the phase for optimizing between a resonator aperture or interaction gap 4/1 and a resonator aperture or interaction gap 4/2. Magnets 9 are integrated into the cavity resonator 5 for focussing the hollow beam 10. A coupling capacitor 11 is provided in the cavity resonator 7. Insulator rings formed of ceramic material are provided with reference symbol 12.

The foregoing is a description corresponding in substance to German Application No. P 33 17 788.0, filed May 16, 1983, the International priority of which is being claimed for the instant application, and which is hereby made part of this application. Any discrepancies between the foregoing specification and the aforementioned corresponding German application are to be resolved in favor of the latter.

I claim:

1. High-gain klystron-tetrode, comprising a tube for accomodating a hollow beam; a ring cathode with a heater, two resonator gap apertures and a collector for generating the hollow beam; a ring grid for current-modulating the hollow beam; an external cavity resonator for current modulation, said external cavity resonator having a tuning slider of a grid-cathode circuit for operating the klystron-tetrode; and a re-entrant output cavity resonator, said reentrant cavity resonator having two independent tuning sliders for generating HF power by setting the resonator frequency and optimizing the phase between said resonator gap apertures for inphase and substantially in-phase operation, and said re-entrant cavity resonator having magnets integrated therein for focussing the hollow beam.

2. Klystron-tetrode according to claim 1, wherein the beam perveance in vicinity of said re-entrant cavity resonator is greater than $2 \cdot 10^{-6} A/V^{3/2}$.

* * * * *